United States Patent [19]

Lubet et al.

[11] Patent Number: 4,677,765

[45] Date of Patent: Jul. 7, 1987

[54] BEACHRUNNERS

[76] Inventors: Carl Lubet, 439 Lafayette St., New York, N.Y. 10003; George Spector, 233 Broadway Rm. 3615, New York, N.Y. 10007

[21] Appl. No.: 834,365

[22] Filed: Feb. 28, 1986

[51] Int. Cl.[4] ..... A43B 03/00; A43B 05/00

[52] U.S. Cl. ..... 36/1.5; 36/128; 36/59 R; 36/67 B; 36/116

[58] Field of Search ..... 36/59 R, 67 D, 134, 36/62, 64–66, 67 R, 67 C, 116, 7.3, 89, 109, 128, 122, 124, 7.6

[56] References Cited

U.S. PATENT DOCUMENTS

| | | | |
|---|---|---|---|
| 509,927 | 12/1893 | Mayer | 36/59 R |
| 1,090,223 | 3/1914 | McNeer | 36/1.5 |
| 1,712,035 | 5/1929 | Frykman | 36/1.5 |
| 3,089,164 | 5/1963 | Meserve | 36/59 R |
| 3,691,659 | 9/1972 | Nakajima | 36/7.6 |

FOREIGN PATENT DOCUMENTS

| | | | |
|---|---|---|---|
| 2109562 | 9/1972 | Fed. Rep. of Germany | 36/7.3 |
| 1215667 | 4/1960 | France | 36/128 |
| 367368 | 1/1939 | Italy | 36/1.5 |
| 3999 | of 1899 | United Kingdom | 36/67 B |
| 19673 | of 1909 | United Kingdom | 36/128 |
| 358336 | 10/1931 | United Kingdom | 36/128 |
| 398698 | 9/1933 | United Kingdom | 36/128 |

*Primary Examiner*—Henry S. Jaudon
*Assistant Examiner*—Steven N. Meyers

[57] ABSTRACT

A running shoe is provided for running along a shore line on a beach and consists of heel and toe cleat structures attached to a sole of a waterproof upper that will give increased traction and stability to the shoe.

2 Claims, 6 Drawing Figures

BEACHRUNNERS

BACKGROUND OF THE INVENTION

The instant invention relates generally to athletic shoes and more specifically it relates to a running shoe for running along a shore line on a beach.

Numerous athletic shoes have been provided in prior art that are adapted to include cleats or the like for traction. For example, U.S. Pat. Nos. 2,367,736; 3,577,663 and 3,816,946 all are illustrative of such prior art. While these units may be suitable for the particular purpose to which they address, they would not be as suitable for the purposes of the present invention as heretofore described.

SUMMARY OF THE INVENTION

A primary object of the present invention is to provide a running shoe for running along a shore line on a beach that will overcome the shortcomings of the prior art devices.

Another object is to provide a running shoe for running along a shore line on a beach that is waterproof and contains cleats which will give increased traction and stability to the shoe.

An additional object is to provide a running shoe for running along a shore line on a beach in which the cleats are removable so that the shoe can be used as a regular shoe on a hard flat surface such as concrete, wood, asphalt or the like.

A further object is to provide a running shoe for running along a shore line on a beach that is simple and easy to use.

A still further object is to provide a running shoe for running along a shore line on a beach that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
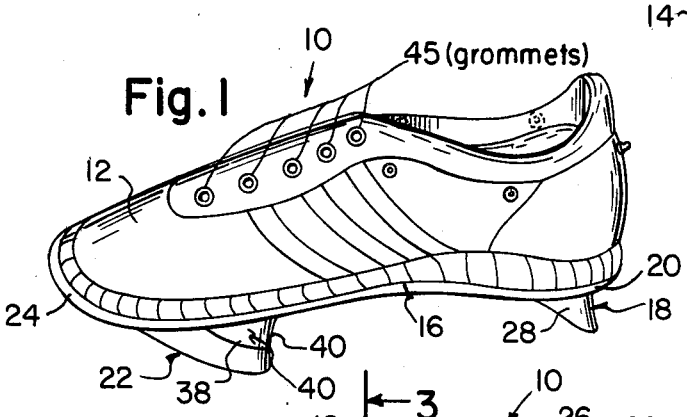
FIG. 1 is a side perspective view of the invention.
Figure 2:
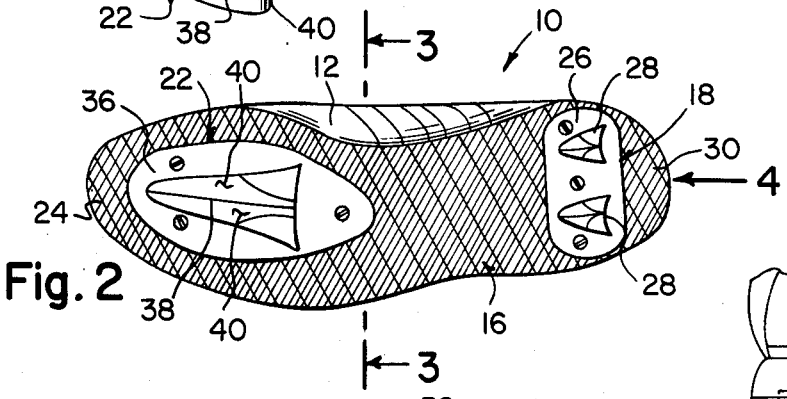
FIG. 2 is a bottom view thereof.
Figure 3:
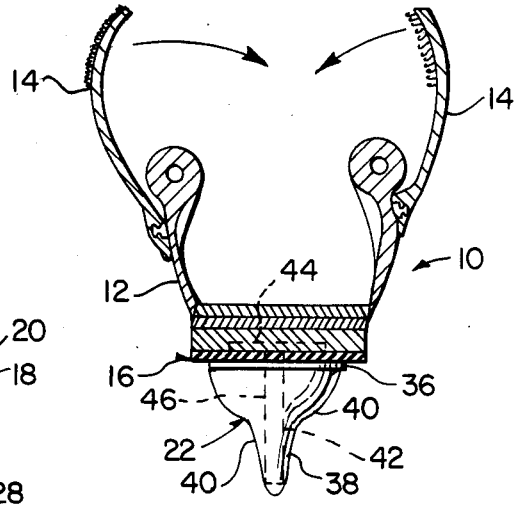
FIG. 3 is a cross sectional view with parts broken away and taken along line 3—3 in FIG. 2 showing the overlapping spot thereon.
Figure 4:
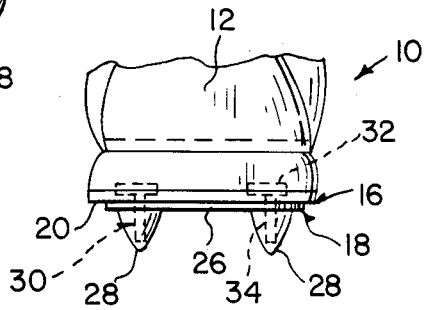
FIG. 4 is a rear view with parts broken away taken in direction of arrow 4 in FIG. 2.

Turning now descriptively to the drawings, in which similar reference characters denote similar elements throughout the several views, FIGS. 1 through 4 illustrates a running shoe 10 for running along a shore line on a beach which contains a waterproof upper 12 that has a removable overlapping spat 14 (see FIG. 3). A deep scored sole 16 is secured to the upper 12. A heel cleat structure 18 is attached transversely across heel portion 20 of the sole 16. A toe cleat structure 22 is attached in alignment to toe portion 24 of the sole 16. This gives increased traction and stability to the shoe 10.

The heel cleat structure 18 contains a flange 26 that has a pair of spaced apart downwardly extending cleats 28 molded thereto. A pair of stiffners 30 are provided, each have a top lip member 32 and a vertical member 34 placed within one of the cleats 28.

The toe cleat structure 22 contains a flange 36 that has a downwardly extending cleat 38 molded thereto. The cleat 36 has a curvature 40 to prevent sand buildup thereon. A stiffner 42 that has a top lip member 44 and a vertical member 46 is placed within the cleat 38.

Figure 5:
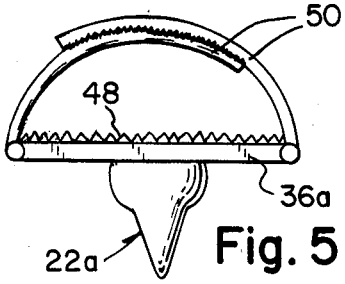
FIG. 5 is a front view of a modification whereby the front cleat is attached to the shoe by velcro straps.

FIG. 5 shows a modified toe cleat structure **22*a*. The flange 36*a* has a deep scored upper surface 48. Hook and loop pile fastener straps 50 are affixed to opposite sides of the flange 36*a*. The deep scored upper surface 48 of the flange 36*a* can bare against the deep scored sole 16 with the straps 50 secured over the upper 12 so that the toe cleat structure 22*a*** can be easily secured and removed therefrom.

Figure 6:
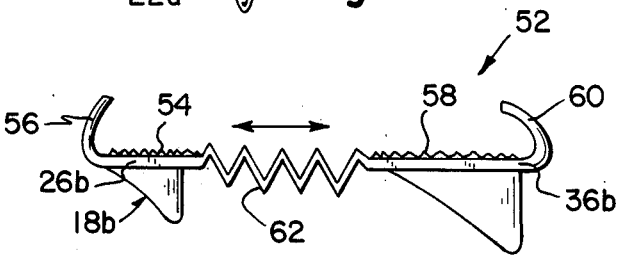
FIG. 6 is a side view of another modification whereby the front and rear cleats are removable attached to the shoe by an expandable connector.

FIG. 6 shows another modification 52. The flange **26*b* of the heel cleat structure 18*b* has a first deep scored upper surface 54 and a heel holder cup 56. The flange 36*b* of the toe cleat structure 22*b* has a second deep scored upper surface 58 and a toe holder cup 60. An expandable portion 62 extends between the flange 26*b* of the heel cleat structure 18*b* and the flange 36*b* of the toe cleat structure 22*b*. The heel holder cup 56 can be clamped onto heel portion of the upper 12 and the toe holder cup 60 can be clamped onto toe portion of the upper 12 with the expandable portion 62 holding the heel cleat structure 18*b* and the toe cleat structure 22*b* on a proper position to the sole 16 of the running shoe 10**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A running shoe for running along a shore line on a beach which comprises:

(a) a waterproof upper having a removable spat;

(b) a deep scored sole secured to said upper;

(c) a heel cleat structure attached transversely across heel portion of said sole; and (d) a toe cleat structure attached in alignment to toe portion of said sole so as to give increased traction and stability to said shoe, wherein said heel cleat structure comprises:

(e) a flange having a pair of spaced apart downwardly extending cleats molded thereto; and (f) a pair of stiffeners, each having a top lip member and a vertical member placed within one of said cleats wherein said toe cleat structure comprises:

(g) a flange having a downwardly extending cleat molded thereto, said cleat having a curvature to prevent sand buildup thereon; and (h) a stiffener having a top lip member and a vertical member placed within said cleat, wherein said toe cleat structure further comprising:

(i) said flange in the toe area having a deep scored upper surface; and (j) hook and loop pile fastener straps affixed to opposite sides of said flange in which said deep scored upper surface of said flange can bear against said deep scored sole with said straps secured over said upper so that said toe cleat structure can be easily secured and removed therefrom.

2. A running shoe for running along a shore line on a beach which comprises:

(a) a water proof upper having a removable spat:

(b) a deep scored sole secured to said upper;

(c) a heel cleat structure attached transversely across heel portion of said sole; and (d) a toe cleatstructure attached in alignment to toe portion of said sole so as to give increased traction and stability to said shoe, wherein said heel cleat structure comprises:

(e) a flange having a pair of spaced apart downwardly extending cleats molded thereto; and (f) a pair of stiffeners, each having a top lip member and a vertical member placed within one of said cleats wherein said toe cleat structure comprises:

(g) a flange having a downwardly extending cleat molded thereto, said cleat having a curvature to prevent sand buildup thereon; and (h) a stiffener having a top lip member and a vertical member placed within said cleat, wherein said toe cleat structure further comprising:

(i) said flange of said heel cleat structure having a first deep scored upper surface and a heel holder cup;

(j) said flange of said toe cleat structure having a second deep scored upper surface and a toe holder cup; and (k) an expandable portion extending between said flange of said heel cleat structure and said flange of said toe cleat sturcture so that said heel holder cup can be clamped onto heel portion of said upper and said toe holder cup can be clamped onto toe portion said upper with said expandable portion holding said heel cleat structure and said toe cleat structure in a proper position to said sole of said running shoe.

* * * * *